US006729918B2

(12) United States Patent
Fuse et al.

(10) Patent No.: US 6,729,918 B2
(45) Date of Patent: May 4, 2004

(54) JET-PROPELLED WATERCRAFT

(75) Inventors: Tomohiro Fuse, Saitama (JP); Jun Nakajima, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/217,654

(22) Filed: Aug. 14, 2002

(65) Prior Publication Data

US 2003/0073357 A1 Apr. 17, 2003

(30) Foreign Application Priority Data

Sep. 18, 2001 (JP) ..... 2001-284060

(51) Int. Cl.[7] ..... B63H 11/11
(52) U.S. Cl. ..... 440/41; 440/42
(58) Field of Search ..... 440/38, 39, 40, 440/41, 42; 114/55.57, 55.51

(56) References Cited

U.S. PATENT DOCUMENTS 5,062,815 A * 11/1991 Kobayashi ..... 440/41
5,067,918 A * 11/1991 Kobayashi ..... 440/39
5,154,650 A * 10/1992 Nakase ..... 440/41
5,474,007 A * 12/1995 Kobayashi ..... 440/42
5,551,898 A * 9/1996 Matsumoto ..... 440/41
5,934,954 A * 8/1999 Schott et al. ..... 440/41
6,428,370 B1 * 8/2002 Jones ..... 440/38

FOREIGN PATENT DOCUMENTS

JP 3121333 10/2000

* cited by examiner

*Primary Examiner*—S. Joseph Morano
*Assistant Examiner*—Lars A. Olson
(74) *Attorney, Agent, or Firm*—Birch, Stewart, Kolasch & Birch, LLP

(57) ABSTRACT

A jet-propelled watercraft capable of eliminating the need for having an operating cable connected to a reverse bucket positioned in a space over a jet propulsion unit. The jet-propelled watercraft configured such that an intermediate lever is disposed in a gap between one of left and right supporting brackets (for example, left supporting bracket) and a steering nozzle. The intermediate lever is swingably mounted to the left supporting bracket, an operating cable is connected to a reverse bucket via the intermediate lever, and a front end of the operating cable is mounted to the operating lever.

18 Claims, 14 Drawing Sheets

PRIOR ART

JET-PROPELLED WATERCRAFT

CROSS-REFERENCE TO RELATED APPLICATION

The present application claims priority under 35 U.S.C. §119 to Japanese Patent Application No. 2001-284060, filed Sep. 18, 2001, the entire contents of which are hereby incorporated by reference.

BACKGROUND OF THE INVENTION

1. Field of the Invention

The present invention relates to a jet-propelled watercraft in which a jet nozzle for jetting water is provided at a stern, a steering nozzle is additionally provided for the jet nozzle, and a reverse bucket is vertically swingably provided behind the steering nozzle.

2. Description of Background Art

Jet-propelled watercrafts are known. One example is disclosed in the Japanese Patent No. 3121333 entitled "Water Jet propulsion unit". The jet-propelled watercraft disclosed in this document will be described in detail with reference to FIG. 14, which is recited from FIG. 3 of JP 3121333. It is to be noted that reference numerals are newly given in the following figure for the sake of convenience.

FIG. 14 is a side view showing an essential portion of the related art jet-propelled watercraft disclosed in the above-described document. A jet-propelled watercraft 100 includes a jet propulsion unit 101 at a stern. A steering nozzle 102 is provided behind the jet propulsion unit 101 in such a manner as to be swingable in the lateral direction around upper and lower supporting shafts 103. A reverse bucket 104 is provided behind the steering nozzle 102 in such a manner as to be swingable in the vertical direction around left and right supporting shafts 105.

When the jet-propelled watercraft 100 is to be propelled forward, an operating cable 106 is operated, to swing the reverse bucket 104 around the supporting shafts 105 as shown by an arrow, thereby shifting the reverse bucket 104 to a forward position P3 located over the steering nozzle 102. This causes a water stream to be jetted in a rearward direction from an outlet 102*a* of the steering nozzle 102, thus propelling the jet-propelled watercraft forward.

On the other hand, when the jet-propelled watercraft 100 is to be propelled in reverse, the operating cable 106 is operated, to swing the reverse bucket 104 around the supporting shafts 105, thereby shifting the reverse bucket 104 to a reverse position P4 on the outlet 102*a* side of the steering nozzle 102, that is, the position shown in FIG. 14. This cause a result that a water stream jetted from the outlet 102*a* of the steering nozzle 102 is introduced forward as shown by an arrow, thus propelling the jetpropelled watercraft 100 in reverse.

In addition, a tensile spring 107 is used as means for holding the reverse bucket 104 at the forward position P3 and the reverse position P4.

The jet-propelled watercraft 100 shown in FIG. 14 has a problem in that the operating cable 106 for operating the reverse bucket 104 must be disposed over the jet propulsion unit 101. As a result, a containing space 108 for disposing the operating cable 106 is required over the jet propulsion unit. This makes it difficult to achieve a low center of gravity of the jet-propelled watercraft 100.

An object of the present invention is to provide a jet-propelled watercraft capable of eliminating the need for having an operating cable connected to a reverse bucket disposed in a space over a jet propulsion unit.

SUMMARY AND OBJECTS OF THE INVENTION

To solve the above-described problem, the present invention provides a jet-propelled watercraft, wherein a jet nozzle for jetting water is provided at a stern, a steering nozzle is additionally provided for the jet nozzle, a lower side of the steering nozzle is covered with a ride plate removably mounted to a hull, a pair of supporting brackets are provided on left and right sides of the ride plate, and a reverse bucket is vertically swingably provided on the pair of supporting brackets. This jet-propelled watercraft includes an intermediate lever disposed in a gap between one of the pair of supporting brackets and the steering nozzle. The intermediate lever is swingably mounted to the one of the supporting brackets, and an operating cable is connected to the reverse bucket via the intermediate lever, whereby the reverse bucket is swung by operating the intermediate lever via the operating cable.

With this configuration, the intermediate lever is disposed in the gap between one of the supporting brackets and the steering nozzle and the operating cable is connected to the reverse bucket via the intermediate lever. As a result, since the operating cable can be disposed along a side surface of the jet propulsion unit, a space which was required previously for disposing the operating cable connected to the reverse bucket in a space over the jet propulsion unit can now be eliminated.

Since the pair of supporting brackets are provided on the left and right sides of the ride plate and the intermediate lever is disposed in the gap between one of the supporting brackets and the steering nozzle, it is possible to ensure a wider gap between the pair of supporting bracket. Hence, the width of the reverse bucket can be increased.

In addition, since the gap between the pair of supporting brackets can be widened, it is possible to ensure a space being large enough to form supporting portions of the reverse bucket which add to the rigidity of the bucket.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
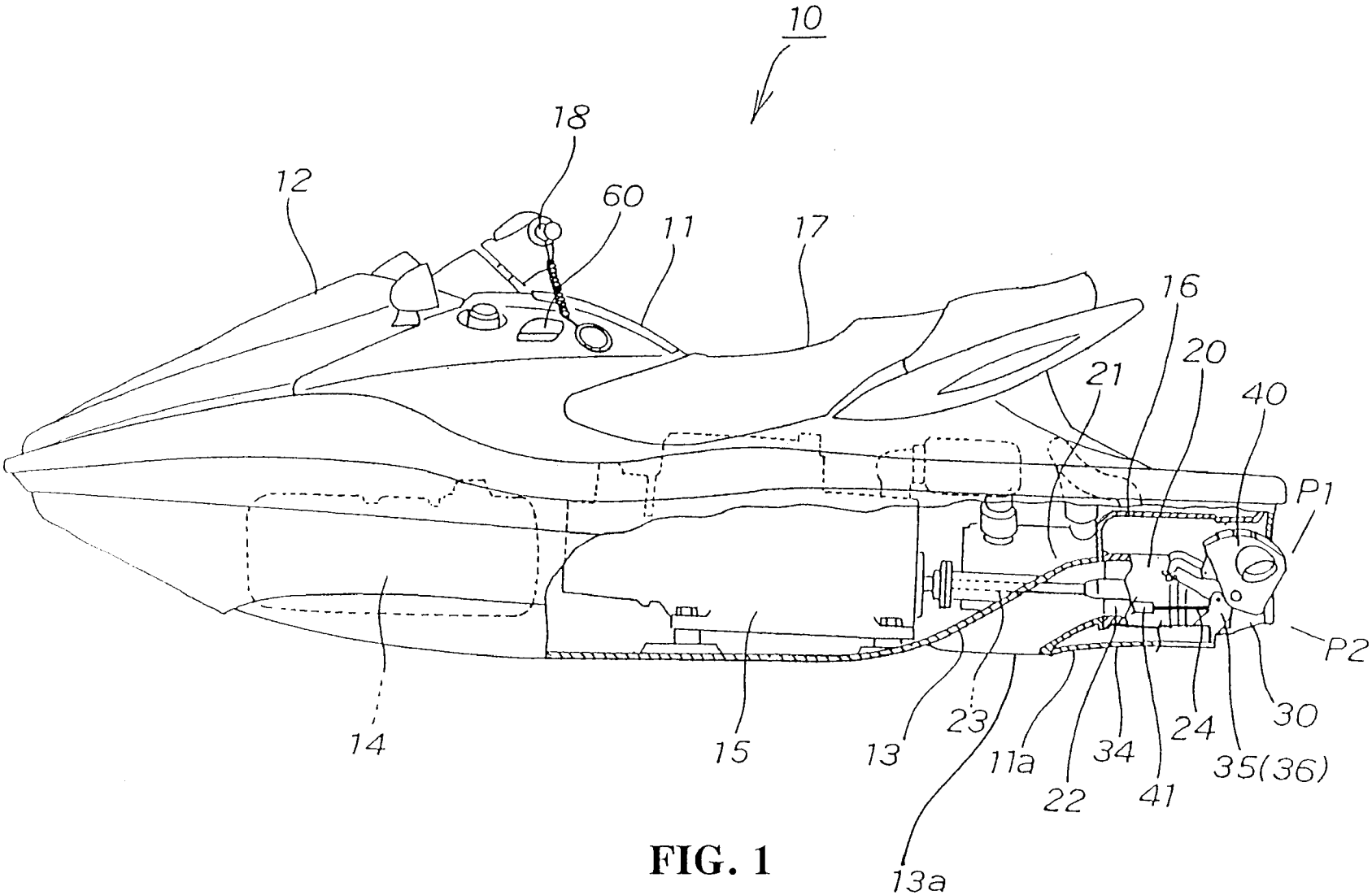
FIG. 1 is a side view of a jet-propelled watercraft according to the present invention.

FIG. 1 is a side view of a jet-propelled watercraft according to an embodiment of the present invention.

A jet-propelled watercraft 10 shown in FIG. 1 includes a hull 11. In the hull 11, a fuel tank 14 is mounted at a front portion 12 of the hull 11, an engine 15 is provided behind the fuel tank 14, and a jet propulsion unit chamber 16 is provided behind the engine 15. In the jet propulsion unit chamber 16, a jet propulsion unit 20 is disposed at a stern 11*a* of the hull 11.

A rear portion of the jet propulsion unit 20 is configured as a jet nozzle 24, to which a steering nozzle 30 additionally mounted thereto. A lower side of the steering nozzle 30 is covered with a ride plate 34 removably mounted to the hull 11. A pair of left and right supporting brackets 35 and 36 are provided on left and right sides of the ride plate 34, respectively. A reverse bucket 40 is swingably provided on the left and right supporting brackets 35 and 36, enabling the reverse bucket to swing vertically. A steering handlebar 18 is provided in front of a seat 17 at a position over the fuel tank 14, and an operating lever 60 for operating the reverse bucket 40 is provided under the operating handlebar 18.

A housing 21 extending rearwardly from a suction port 13*a* formed in a bottom shell 13. An impeller 22 is rotatably mounted in the housing 21 in such a manner as to be connected to a drive shaft 23 of the engine 15.

The steering nozzle 30 is a member laterally swingably mounted to a rear end of the housing 21 (that is, an outlet of the jet nozzle 24). Since the steering handlebar 18 is connected to the steering nozzle 30 via an operating cable as described above, the steering nozzle 30 can be laterally swung by operating the steering handlebar 18.

The reverse bucket 40 is a member swingably mounted to the left and right supporting brackets 35 and 36 provided on the left and right sides of the ride plate 34. The jet-propelled watercraft 10 can be propelled forward by shifting the reverse bucket 40 to a forward position P1 located over the steering nozzle 30. On the other hand, the jet-propelled watercraft 10 can propelled in reverse by shifting the reverse bucket 40 to a reverse position P2 located behind the steering nozzle 30.

The operating lever 60 is connected to the reverse bucket 40 via an operating cable 41. Accordingly, the reverse bucket 40 can be vertically swung by operating the operating lever 60.

The jet-propelled watercraft 10 is propelled forward by shifting the reverse bucket 40 to the forward position P1 located over the steering nozzle 30. This operation supplies fuel from the fuel tank 14 to the engine 15 to drive the engine 15 and transmits a drive force of the engine 15 to the impeller 22 via the drive shaft 23.

The engine 15 drives the impeller 22 which then draws water from the suction port 13*a* of the bottom shell 13, and jets the water as a water jet stream from an outlet 31' of the steering nozzle 30 via an outlet 25 of the jet nozzle 24 at a rear end of the housing 21.

Figure 2:
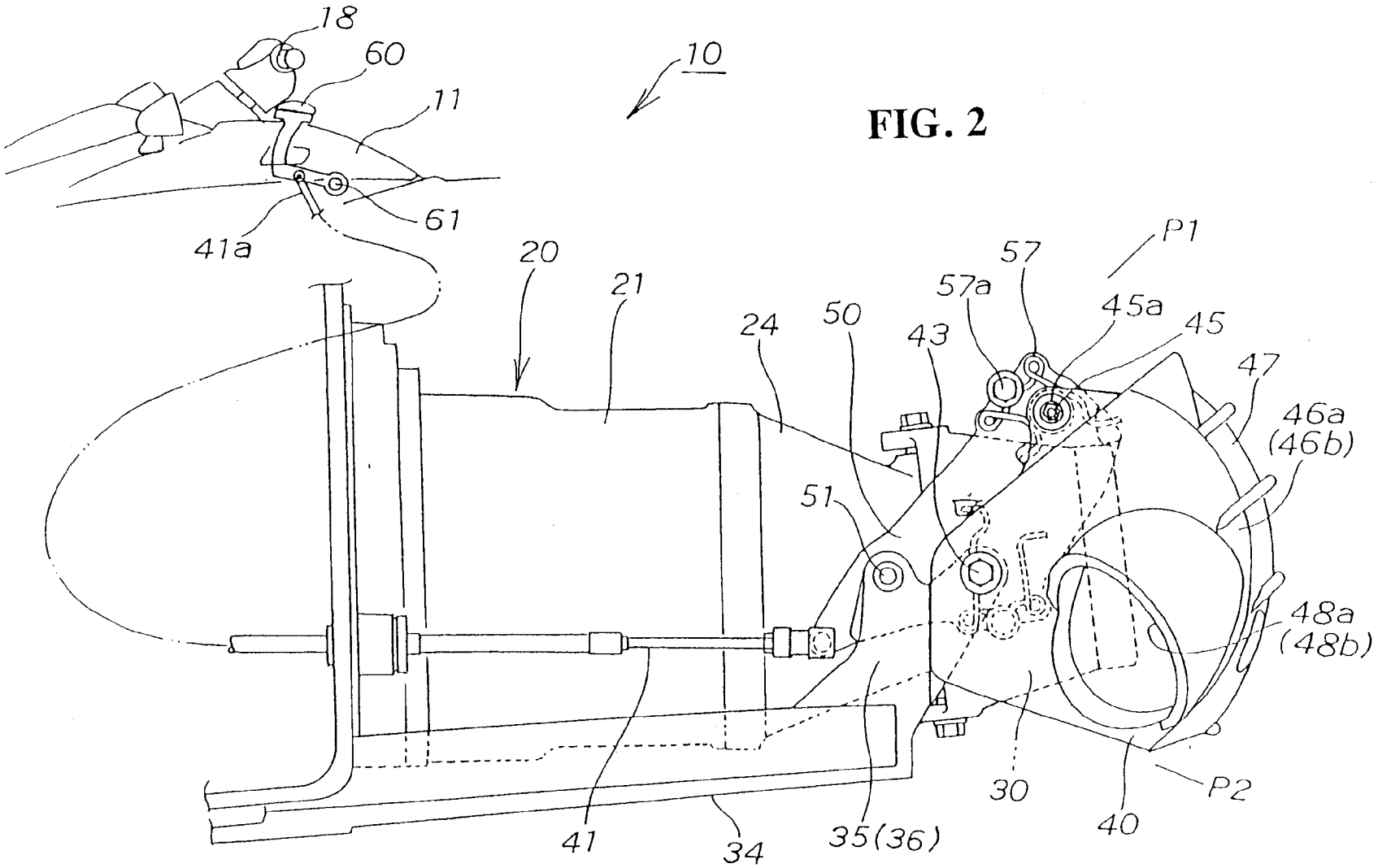
FIG. 2 is a side view showing an essential portion of the jet-propelled watercraft according to the present invention.

FIG. 2 is a side view showing an essential portion of the jet-propelled watercraft according to the present invention. This figure shows a state in which the steering nozzle 30 is additionally mounted to the jet nozzle 24 at the rear portion of the jet propulsion unit 20, and the lower side of the steering nozzle 30 is covered with the ride plate 34 removably provided on the hull 11. Also shown are the left and right supporting brackets 35 and 36 provided on the left and right sides of the ride plate 34 respectively, and the reverse bucket 40 vertically swingably provided on the left and right brackets 35 and 36.

Another feature of the jet-propelled watercraft 10 is an intermediate lever 50 disposed in a gap 42 (shown in FIG. 4) between one of the left and right supporting brackets 35 and 36 (left supporting bracket 35 in the example shown in the figures) and the steering nozzle 30. The intermediate lever 50 is swingably mounted to the left supporting bracket 35. The operating cable 41 is connected to the reverse bucket 40 via the intermediate lever 50. The operating lever 60 is mounted to a front end 41*a* of the operating cable 41.

When the operating lever 60 is vertically swung around a supporting shaft 61, the intermediate lever 50 is swung in a vertical direction around a supporting bolt 51 by operating the operating cable 41. With this swinging motion of the intermediate lever 50, the reverse bucket 40 can be vertically swung around a supporting bolt 43.

As a result, the reverse bucket 40 can be shifted between the forward position P1 located above the steering nozzle 30, and the reverse position P2 (the position shown in FIG. 2) located behind the steering nozzle 30.

Figure 3:
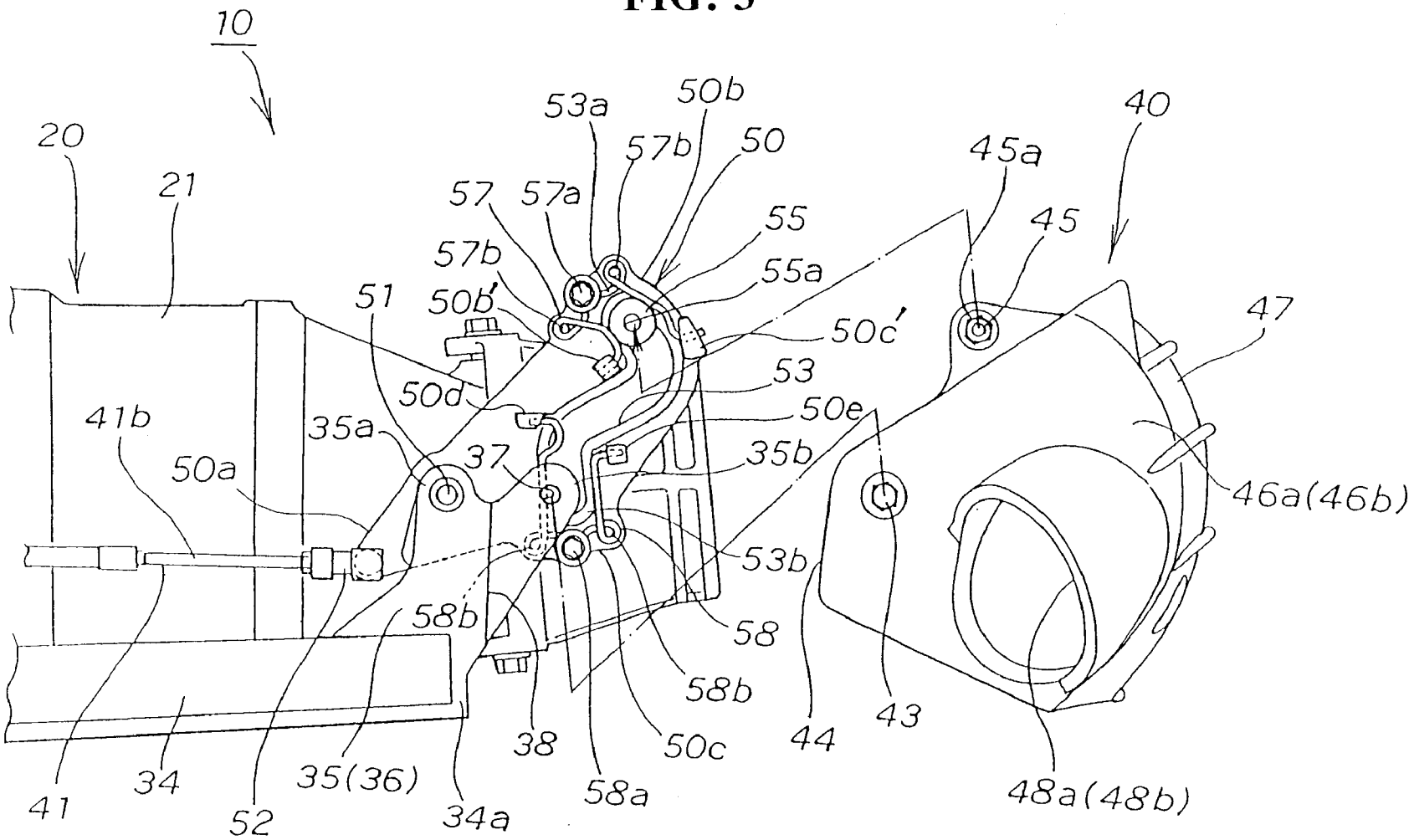
FIG. 3 is an exploded side view showing an essential portion of the jet-propelled watercraft according to the present invention.

FIG. 3 is an exploded side view showing an essential portion of the jet-propelled watercraft according to the present invention.

The left supporting bracket 35 is formed into a shape raised up rearwardly from a rear end 34*a* of the ride plate 34. A portion, near a lower end portion 50*a*, of the intermediate lever 50 is rotatably mounted to a front side upper end portion 35*a* of the left supporting bracket 35 via the supporting bolt 51. A mounting hole 37 for supporting the reverse bucket 40 is formed in a rear side upper end portion 35*b* of the left supporting bracket 35. A stopper 38 is formed at a central portion of an outer side surface of the left supporting bracket 35 in such a manner as to project upright therefrom.

The reverse bucket 40 can be bought to rest in the reverse position P2 (see FIG. 2) by bringing a stopper piece 44 of the reverse bucket 40 into contact with the stopper 38 formed on the left supporting bracket 35.

The reverse bucket 40 can be vertically swingably mounted by inserting a mounting bolt 45 in the mounting hole 37.

It is to be noted that the right supporting bracket 36 has the same configuration as that of the left supporting bracket 35. Therefore, parts of the right supporting bracket 36, corresponding to those of the left supporting bracket 35, are denoted by the same reference numerals and the overlapped description thereof is omitted.

The intermediate lever 50 is configured such that a joint 52 is mounted to the lower end portion 50*a*, and a guide groove 53 is formed into a crank shape in a region from an upper end portion 50*b* to a central portion 50*c*. A slide member 55 is movably disposed in the guide groove 53, a reverse lock spring 57 is mounted to an outer side surface, on the upper end 53*a* side, of the guide groove 53, and a forward lock spring 58 is mounted to an outer side surface, on the lower end 53*b* side, of the guide groove 53.

The intermediate lever 50 can be connected to the operating lever 60 (see FIG. 2) by connecting a rear end 41*b* of the operating cable 41 to the joint 52.

The slide member 55 can be connected to the reverse bucket 40 by inserting the mounting bolt 45 of the reverse bucket 40 in a through-hole 55*a* of the slide member 55, and screwing a nut 45*a* around a leading end portion of the mounting bolt 45.

A central portion of an upper end of the reverse lock spring 57 is mounted to the intermediate lever 50 with a bolt 57*a*. End portions, located on both sides of the bolt 57*a*, of the reverse lock spring 57 are wound around two pins 57*b*, respectively, and extend along the upper end 53*a* of the guide groove 53. Leading ends of the end portions of the reverse lock spring 57, which thus extend along the upper end 53*a* of the guide groove 53, are supported slidably by supporting pieces 50*b*' and 50*c*', respectively.

When moved to the upper end 53*a* of the guide groove 53, the slide member 55 is clamped by the reverse lock spring 57 configured as described above.

A central portion of a lower end of the forward lock spring 58 is mounted to the intermediate lever 50 with a bolt 58*a*. End portions, located on both sides of the bolt 58*a*, of the forward lock spring 58 are wound around two pins 58*b*, respectively, and extend along the lower end 53*b* of the guide groove 53. Leading ends of the end portions of the forward lock spring 58, which thus extend along the lower end 53*b* of the guide groove 53, are supported slidably by supporting pieces 50*d* and 50*e*, respectively.

When moved to the lower end 53*b* of the guide groove 53, the slide member 55 is clamped by the forward lock spring 58 configured as described above.

The operating cable 41 can be disposed along a side wall of the housing 21 of the jet propulsion unit 20 by connecting the operating cable 41 to the lower end portion 50*a* of the intermediate lever 50 via the joint 52. Accordingly, since there is no requirement to dispose the operating cable 41 over the housing 21, it is possible to eliminate the space for disposing the operating cable 41 in a space over the housing 21 which previously was required.

As a result, it is possible to reduce the height and to lower the center of gravity of the jet-propelled watercraft 10.

The reverse bucket 40 includes a curved rear wall 47 which extends between left and right side walls 46*a* and 46*b*. The left and right side walls 46*a* and 46*b* have jet ports 48*a* and 48*b*, respectively. Two supporting bolts 43 are mounted on the left and right side walls 46*a* and 46*b*, respectively. The reverse bucket 40 is swingably supported by the left and right supporting brackets 35 and 36 by inserting the supporting bolts 43 in the mounting holes 37 of the left and right supporting brackets 35 and 36, respectively. The reverse bucket 40 is also connected to the slide member 55 with the mounting bolts 45.

In such a state, the slide member 55 is slidably supported in the guide groove 53.

Figure 4:
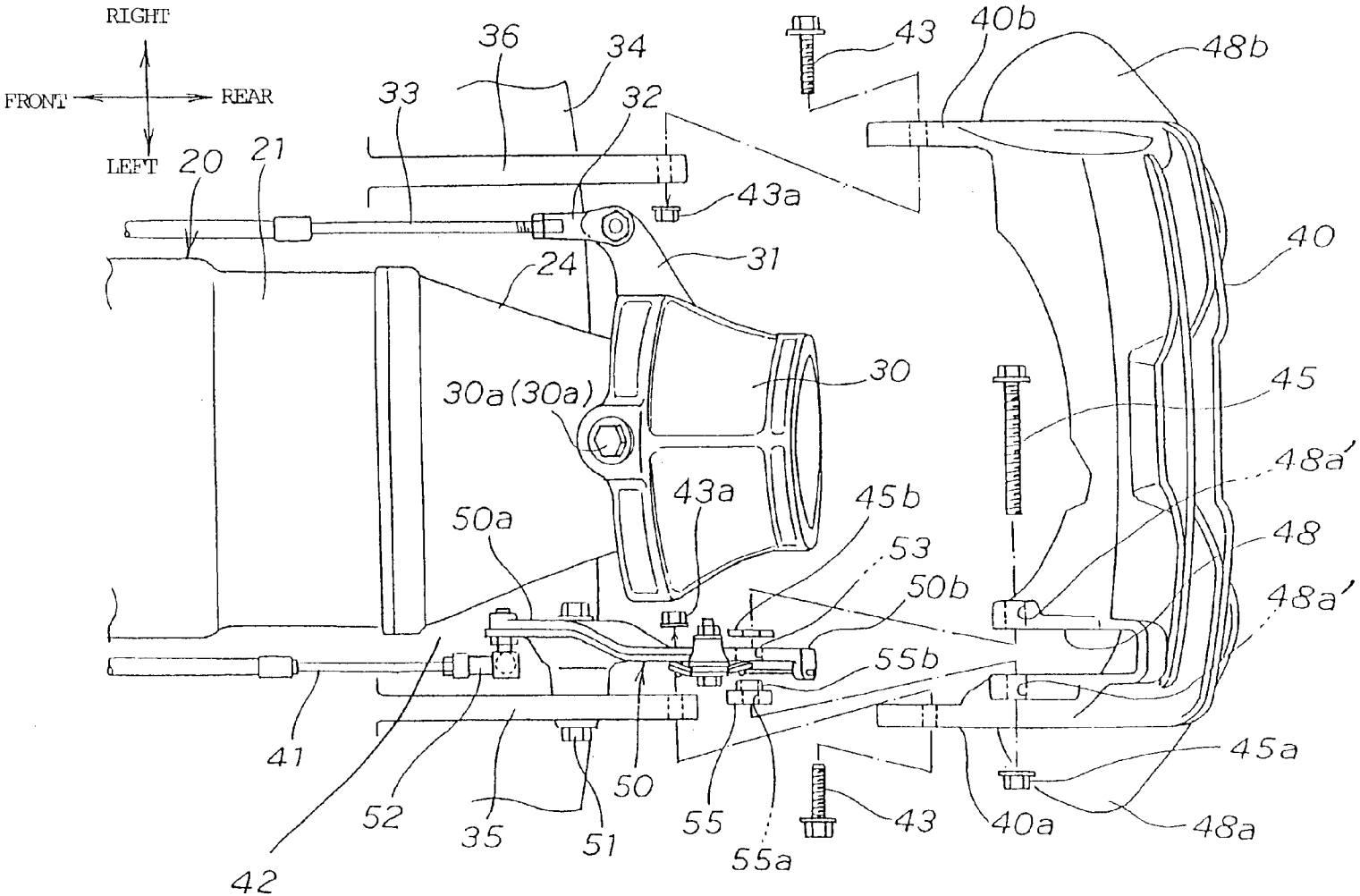
FIG. 4 is an exploded plan view showing an essential portion of the jet-propelled watercraft according to the present invention.

FIG. 4 is an exploded plan view showing an essential portion of the jet-propelled watercraft according to the present invention. This figure shows a state that the left and right supporting brackets 35 and 36 are provided on the left and right sides of the ride plate 34, that is, on the left and right sides of the steering nozzle 30. The reverse bucket 40 is vertically swingably provided on the left and right supporting brackets 35 and 36 with the left and right supporting bolts 43 and the associated nuts 43*a*, and a containing pocket 48 is formed in a left end portion of the reverse bucket 40. The upper end portion 50*b* of the intermediate lever 50 is inserted in the containing pocket 48, and the inserted intermediate lever 50 is mounted to the reverse bucket 40 with the mounting bolt 45 and the associated nut 45*a*.

When mounting the intermediate lever 50 in the containing pocket 48 with the mounting bolt 45 passing through two mounting holes 48*a*' formed in the containing pocket 48, a spacer 45*b* is placed on an inner side of the intermediate lever 50 and the slide member 55 is disposed on an outer side of the intermediate lever 50, whereby a gap between the intermediate lever 50 and the containing pocket 48 is preferably adjusted.

In addition, a projection 55*b* of the slide member 55 is slidably fit into the guide groove 53.

FIG. 4 also shows a state that the intermediate lever 50 is disposed between the left supporting bracket 35 and the steering nozzle 30, the intermediate lever 50 is swingably supported by the left supporting bracket 35 with the supporting bolt 51. Further shown is the operating cable 41 connected to the lower end portion 50*a* of the intermediate lever 50 via the joint 52, whereby the operating cable 41 is disposed along a left side wall of the housing 21.

The reverse bucket 40 can swing vertically around the left and right supporting bolts 43 by operating the operating cable 41 using the operating lever 60 shown in FIG. 2.

FIG. 4 further shows a state that an arm 31 extends outwardly from a right side wall of the steering nozzle 30. An operating cable 33 for steering is connected to a leading end of the arm 31 via a joint 32 and extends therefrom along a right side wall of the housing 21.

The steering nozzle 30 can swing laterally around upper and left supporting shafts 30*a* by operating the operating cable 33 for steering using the operating handlebar 18 shown in FIG. 2.

As shown in FIG. 4, since the left and right supporting brackets 35 and 36 are provided on the left and right sides of the ride plate 34 and the intermediate lever 50 is disposed in the gap 42 between the left supporting bracket 35 and the steering nozzle 30, it is possible to ensure a wide gap between the left and right supporting brackets 35 and 36.

Accordingly, it is possible to widen a width of the reverse bucket 40. As a result, water jetted from the steering nozzle 30 can be more efficiently introduced into the reverse bucket.

In addition, since the gap between the left and right supporting brackets 35 and 36 is relatively wide, the space is large enough to form left and right supporting portions 40*a* and 40*b* of the reverse bucket 40, thereby adding to the rigidity to the reverse bucket 40.

Figure 5:
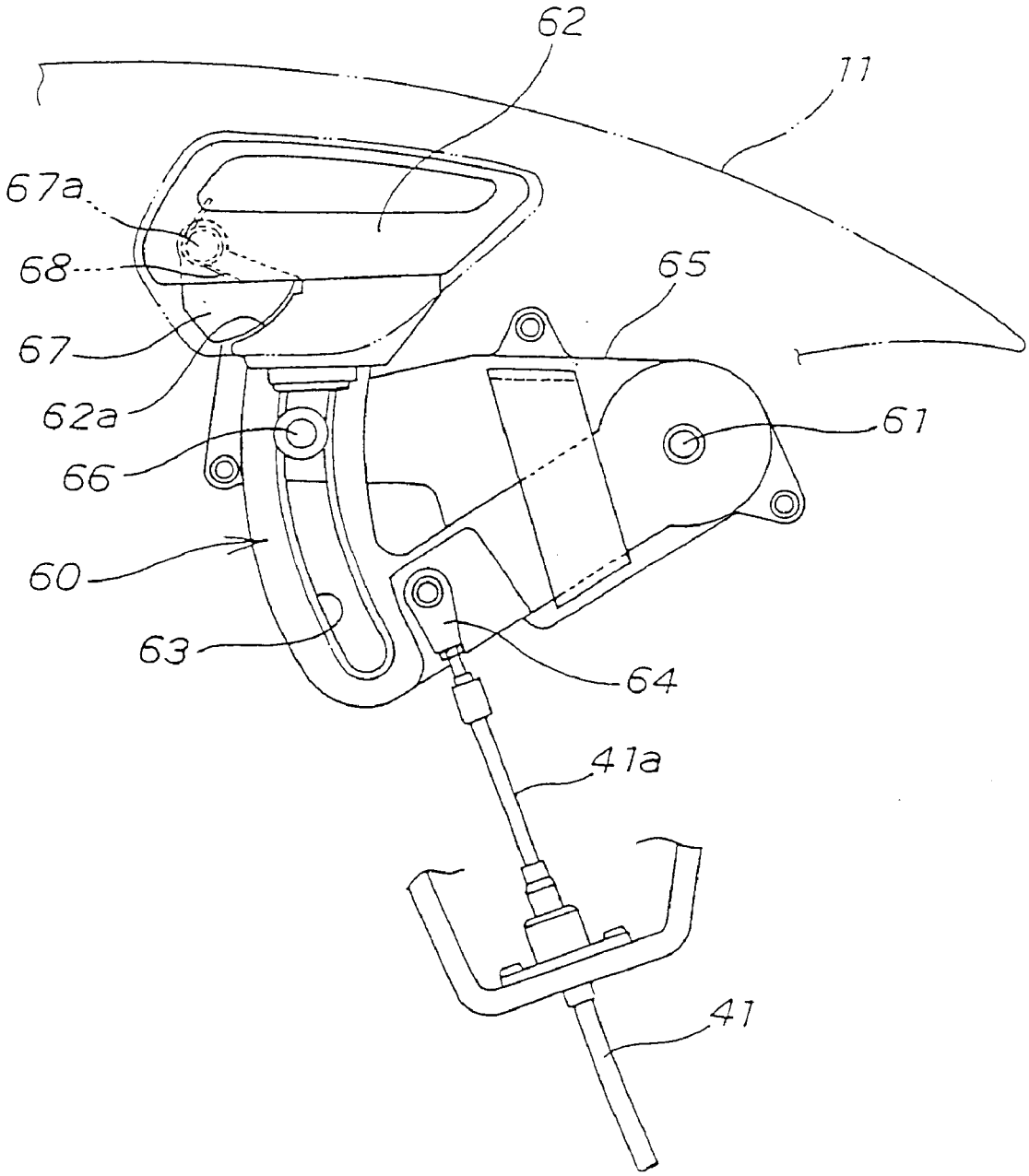
FIG. 5 is an enlarged view of an essential portion shown in FIG. 2.

FIG. 5 is an enlarged view of an essential portion of FIG. 2, showing a fixed bracket 65 mounted to the hull 11, and the operating lever 60 swingably mounted on the fixed bracket 65 via a supporting shaft 61.

The operating lever 60 is formed into an approximately V-shape. At its upper end, a handhold 62 is provided. Also, it is formed with a curved guide groove 63 extending downwardly from the upper end. A rod 66 is inserted in the guide groove 63, and is mounted to the fixed bracket 65. A front end 41*a* of the operating cable 41 is connected to a lower end portion of the operating lever 60 via a joint 64.

When the handhold 62 is manually pulled up, the operating lever 60 is swung upwardly, to pull up the operating cable 41, whereby the reverse bucket 40 (see FIG. 2) can be shifted to the reverse position P2.

On the other hand, when the handhold 62 is depressed, the operating lever 60 is swung downwardly, to pull down the operating cable 41, whereby the reverse bucket 40 (see FIG. 2) can be shifted to the forward position P1.

The handhold 62 has a recess 62*a* and a lock member 67 fitting into the recess 62*a*, whereby the handhold 62 is kept at the position shown in FIG. 5. The locking state of the handhold 62 can be released by swinging the lock member 67 around a supporting shaft 67*a* against a spring force of a lock spring 68, with a result that the handhold 62 can be pulled up.

An operation of the jet-propelled watercraft 10 will be described below. First, an example that the reverse bucket of the jet-propelled watercraft 10 is shifted from the forward position P1 to the reverse position P2 will be described with reference to FIGS. 6(*a*), 6(*b*), 7(*a*), 7(*b*), 8(*a*), 8(*b*), 9(*a*) and 9(*b*).

Figure 6A:
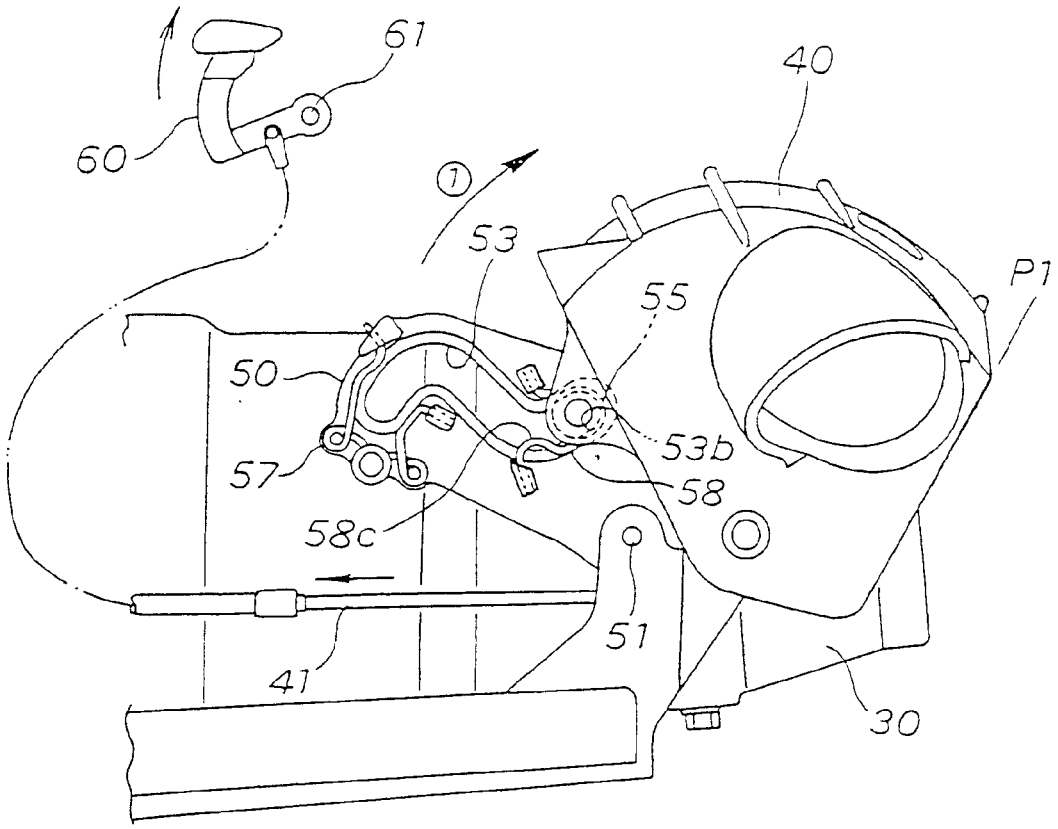
FIGS. 6(*a*) and 6(*b*) are views illustrating a first operation of the jet-propelled watercraft according to the present invention.
Figure 6B:
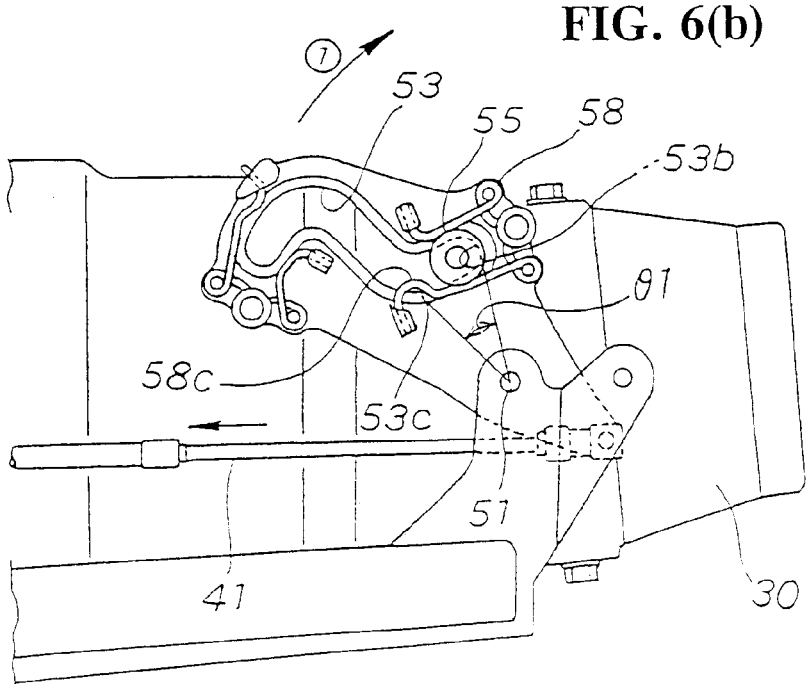

FIGS. 6(*a*) and 6(*b*) are views illustrating a first operation of the jet-propelled watercraft according to the present invention, wherein FIG. 6(*b*) shows a state that the reverse bucket 40 is removed from a state shown in FIG. 6(*a*).

FIG. 6(*a*) shows the state that the reverse bucket 40 is located at the forward position P1.

The operating cable 41 is operated as shown by an arrow by swinging, in such a state, the operating lever 60 upward around the supporting shaft 61 as shown by an arrow, thereby swinging the intermediate lever 50 around the supporting bolt 51 as shown by an arrow ①.

FIG. 6(*b*) shows a state that the slide member 55 located at the lower end 53*b* of the guide groove 53 is clamped by the forward lock spring 58. To be more specific, in this state, the slide member 55 is held between the lower end 53*b* of the guide groove 53 and a projecting portion 58*c* of the forward lock spring 58, so that the intermediate lever 50 is held at the position shown in FIG. 6(*b*), thereby holding the reverse bucket 40 shown in FIG. 6(*a*) at the forward position P1.

A portion of the guide groove 53 between the lower end 53*b* and a portion 53*c* is formed into a circular-arc centered at the supporting bolt 51. It is to be noted that the circular-arc between the lower end 53*b* and the portion 53*c* is open by an angle θ1. As a result, in the circular-arc region, even if the intermediate lever 50 is swung as shown by an arrow ①, both the reverse bucket 40 and the slide member 55 are kept in a rested position, and the forward lock spring 58 is moved in a direction where it becomes apart from the slide member 55.

Figure 7A:
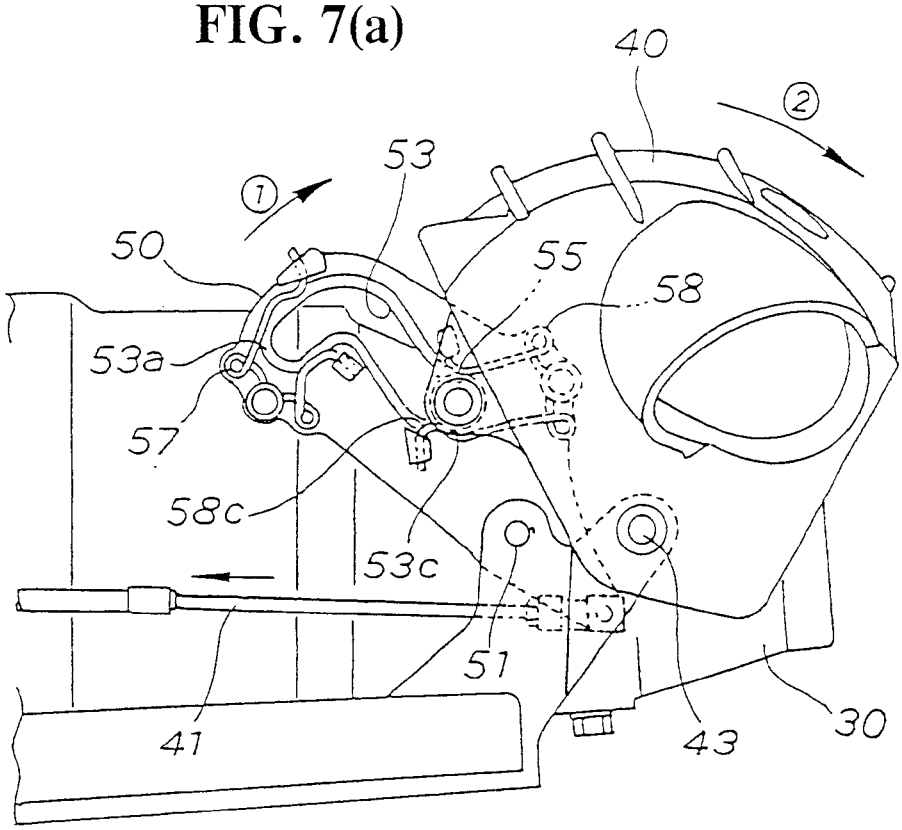
FIGS. 7(*a*) and 7(*b*) are views illustrating a second operation of the jet-propelled watercraft according to the present invention.
Figure 7B:
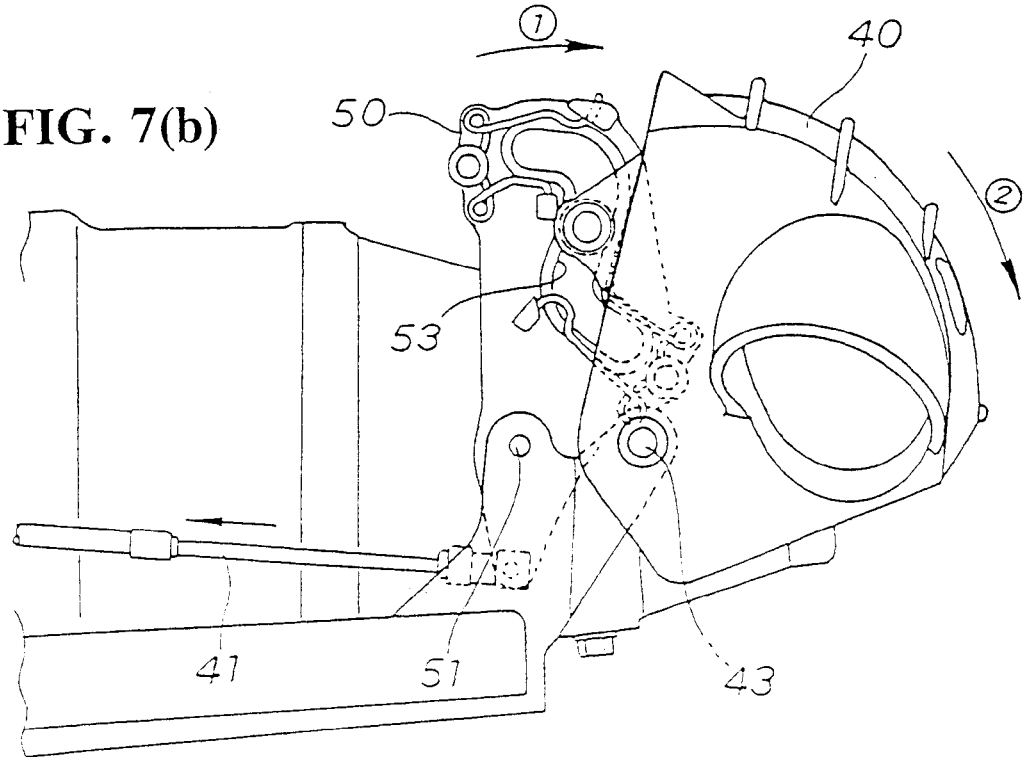

FIGS. 7(*a*) and 7(*b*) are views illustrating a second operation of the jet-propelled watercraft according to the present invention. As shown in FIG. 7(*a*), when the portion 53*c* of the guide groove 53 reaches the slide member 55, the slide member 55 comes in contact with the projecting portion 58*c* of the forward lock spring 58, to pushed out the projecting portion 58*c*.

In this state, when the intermediate lever 50 is swung further, as shown by an arrow ①, the slide member 55 moves along the groove 53 toward the upper end 53*a* of the guide groove 53, thus swinging the reverse bucket 40 around the supporting bolt 43 as shown by an arrow ②.

As shown in FIG. 7(*b*), the reverse bucket 40 swings continuously in a direction shown by an arrow ② by continuing to operate the operating cable 41 as shown by an arrow. This occurs as the result of the continuous swinging of the intermediate lever 50 around the supporting bolt 51 as shown by an arrow ①.

Figure 8A:
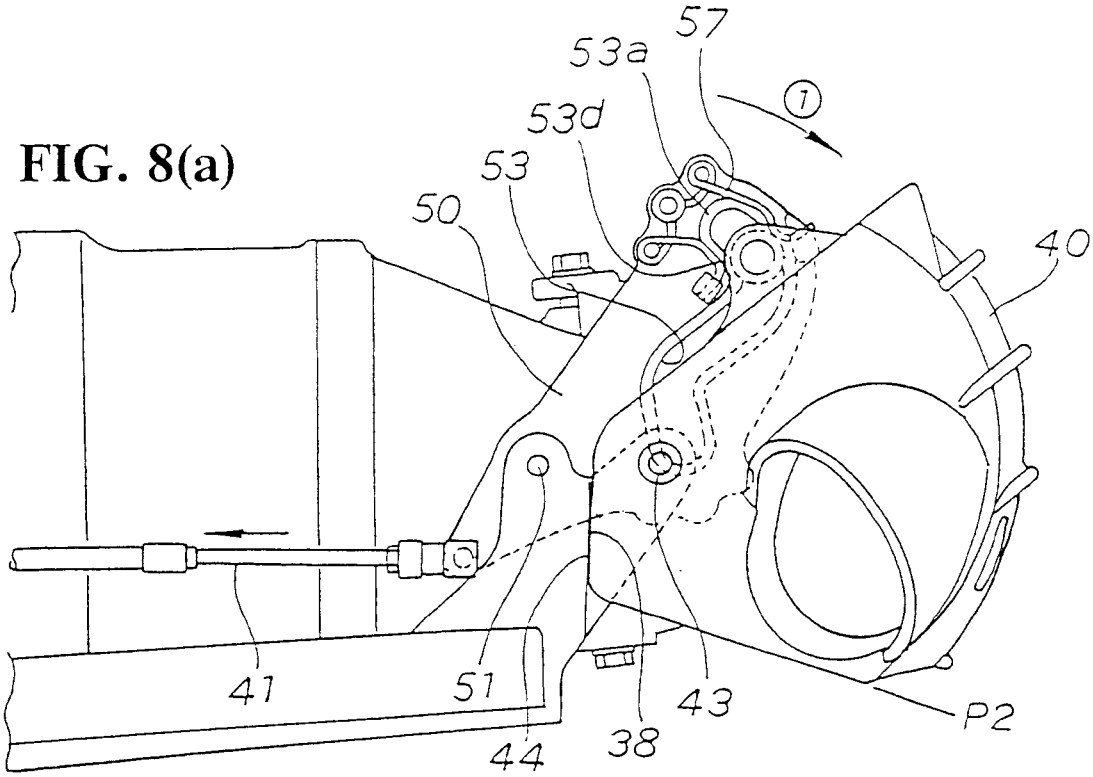
FIGS. 8(*a*) and 8(*b*) are views illustrating a third operation of the jet-propelled watercraft according to the present invention.
Figure 8B:
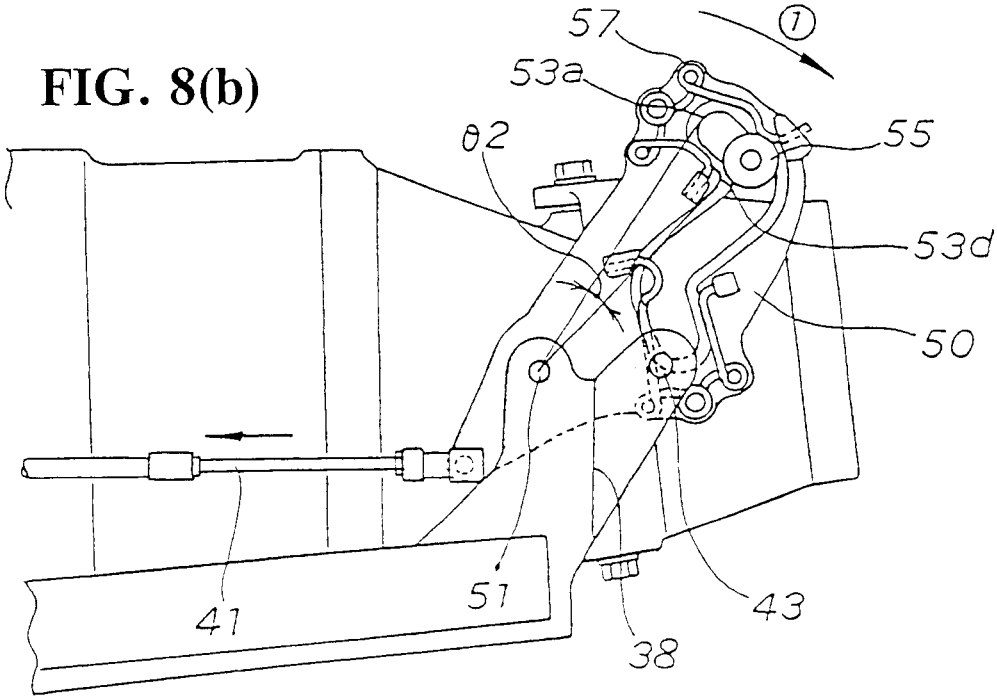

FIGS. 8(*a*) and 8(*b*) are views illustrating a third operation of the jet-propelled watercraft according to the present invention, wherein FIG. 8(*b*) shows a state that the reverse bucket 40 is removed from a state shown in FIG. 8(*a*).

As shown in FIG. 8(*a*), when the slide member 55 reaches a portion 53*d* of the guide groove 53, the stopper piece 44 of the reverse bucket 40 comes in contact with the stopper 38 of the left supporting bracket 35, so that the reverse bucket 40 comes to a rested position at the reverse position P2.

A portion of the guide groove 53 between the portion 53*d* and the upper end 53*a* is formed into a circular-arc centered at the supporting bolt 51. It is to be noted that the circular-arc between the portion 53*d* and the upper end 53*a* is open by an angle θ2. As a result, in the circular-arc region, even if the intermediate lever 50 is swung as shown by an arrow ①, both the reverse bucket 40 and the slide member 55 are kept in the rested position.

Figure 9A:
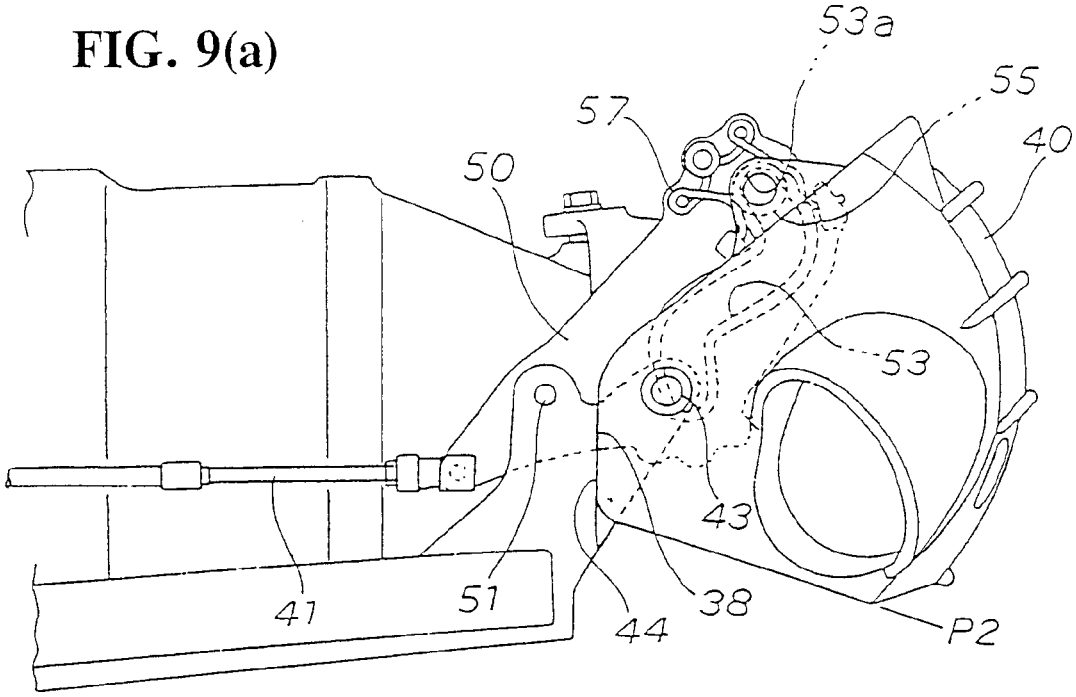
FIGS. 9(*a*) and 9(*b*) are views illustrating a fourth operation of the jet-propelled watercraft according to the present invention.
Figure 9B:
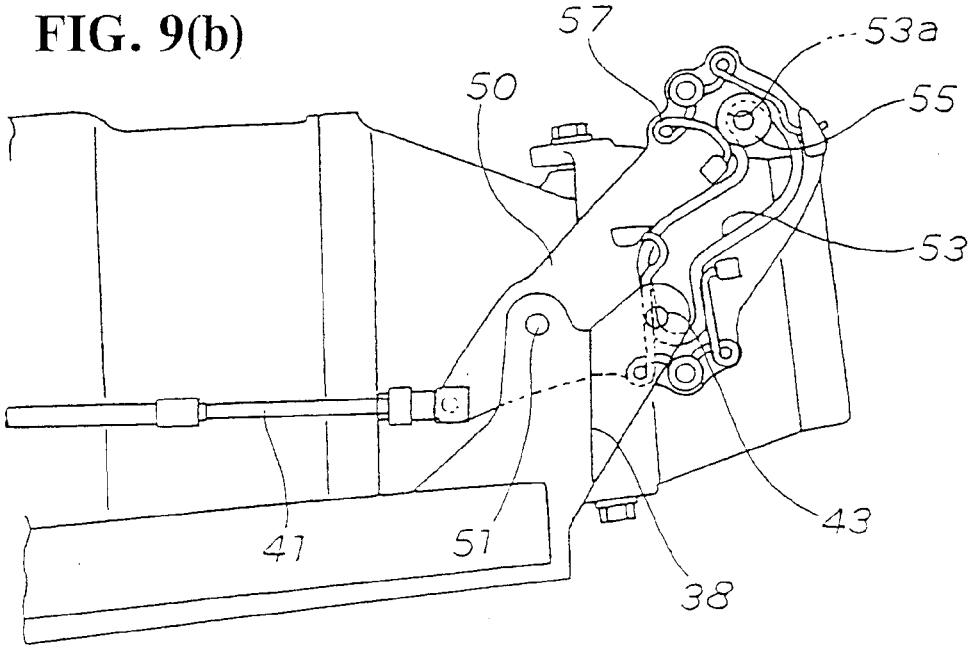

FIGS. 9(*a*) and 9(*b*) are views illustrating a fourth operation of the jet-propelled watercraft according to the present invention, wherein FIG. 9(*b*) shows a state that the reverse bucket 40 is removed from a state shown in FIG. 9(*a*).

As shown in FIG. 9(*a*), when the upper end 53*a* of the guide groove 53 comes in contact with the slide member 55, the intermediate lever 50 is rested. The operation of shifting the reverse bucket 40 to the reverse position P2 is thus complete.

In such a state, since the slide member 55 is in the contact state with the upper end 53*a* of the guide groove 53 and the stopper piece 44 of the reverse bucket 40 is in the contact state with the stopper piece 38 of the left supporting bracket 35, the reverse bucket 40 can be kept at the reverse position P2.

FIG. 9(*b*) shows a state that the slide member 55 is clamped by the reverse lock spring 57. When clamped by the reverse lock spring 57, the slide member 55 expands the reverse lock spring 57, thereby giving a slight resistance to the operating lever 60 (see FIG. 6(*a*)). As a result, a driver can sense the fact that the reverse bucket 40 has been just set to the reverse position P2.

Next, an example in which the reverse bucket of the jet-propelled watercraft 10 is shifted from the reverse position P2 to the forward position P1 will be described with reference to FIGS. 10(*a*), 10(*b*), 11(*a*), 11(*b*) and 12.

Figure 10A:
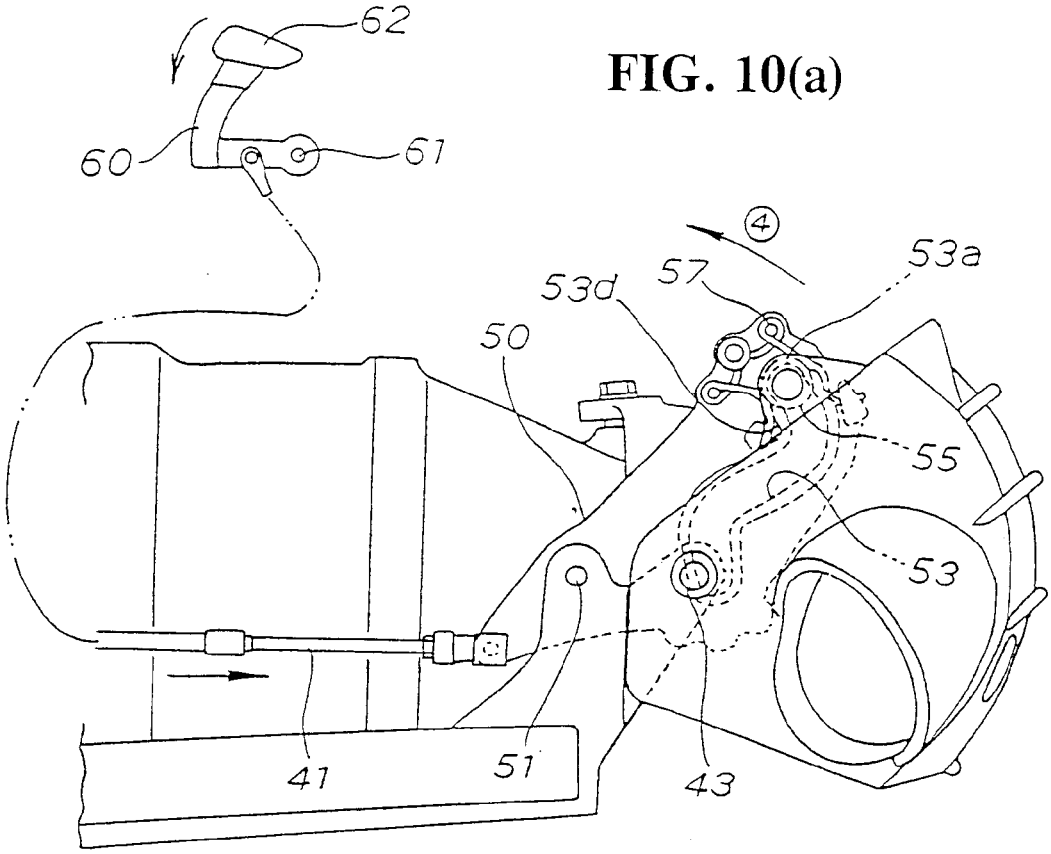
FIGS. 10(*a*) and 10(*b*) are views illustrating a fifth operation of the jet-propelled watercraft according to the present invention.
Figure 10B:
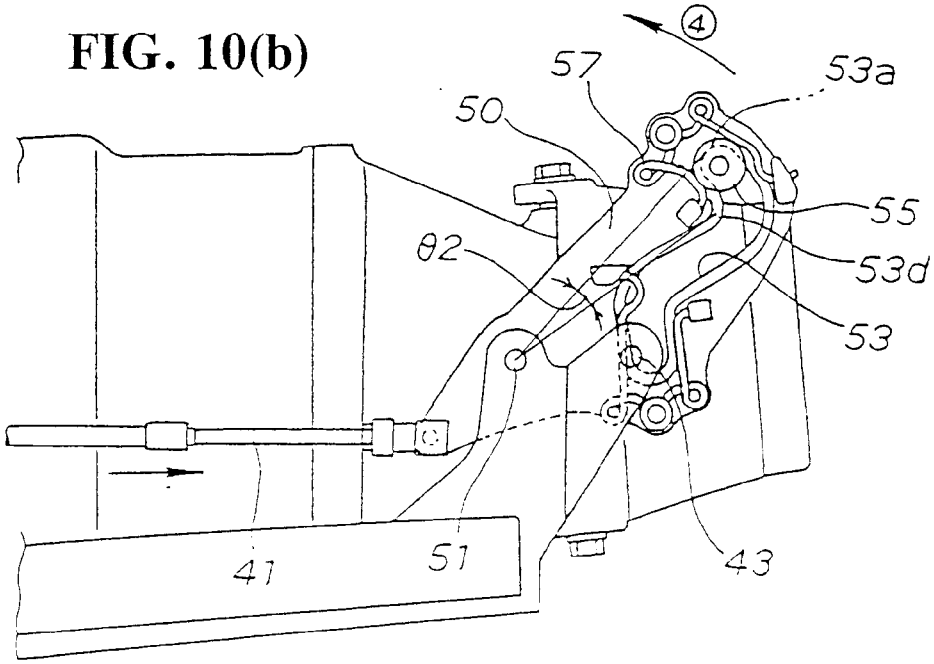

FIGS. 10(*a*) and 10(*b*) are views illustrating a fifth operation of the jet-propelled watercraft according to the present invention, wherein FIG. 10(*b*) shows a state in which the reverse bucket 40 is removed from a state shown in FIG. 10(*a*).

As shown in FIG. 10(*a*), the operating cable 41 is operated as shown by an arrow by swinging downward the operating lever 60 around the supporting shaft 61 as shown by an arrow, thereby swinging the intermediate lever 50 around the supporting bolt 51 as shown by an arrow ④.

As shown in FIG. 10(*b*), a portion, between the upper end 53*a* and the portion 53*d*, of the guide groove 53 is formed into a circular-arc centered at the supporting bolt 51. It is to be noted that the circular-arc between the upper end 53*a* and the portion 53*d* is opened by an angle θ2. As a result, in the circular-arc region, even when the intermediate lever 50 is swung as shown by an arrow ④, both the reverse bucket 40 and the slide member 55 are kept in a rested position. In this position, the reverse lock spring 57 is moved in a direction where it becomes apart from the slide member 55.

Figure 11A:
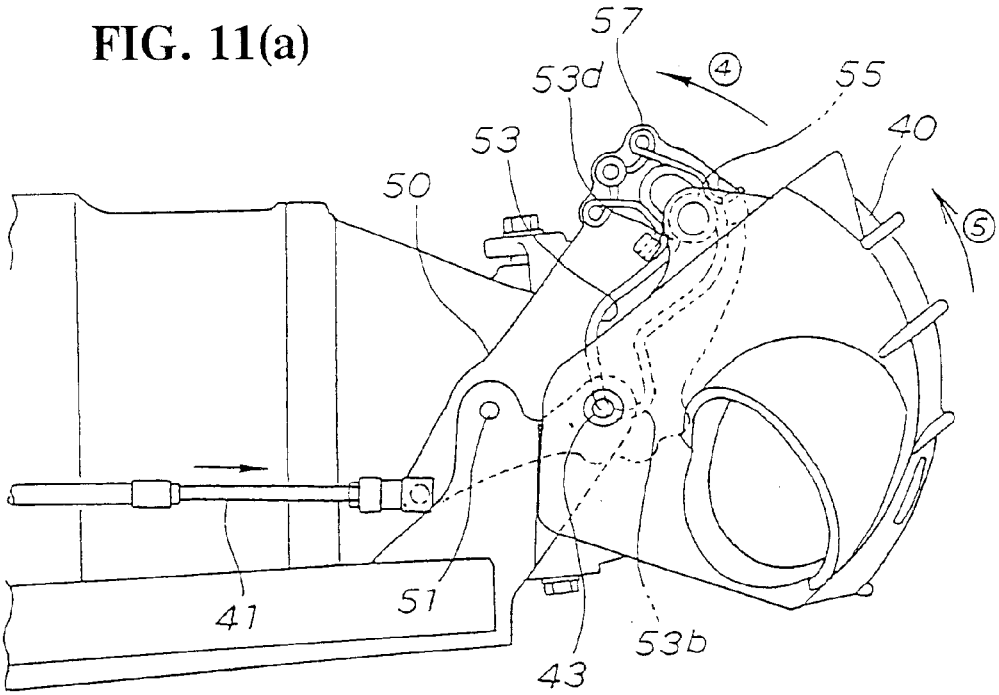
FIGS. 11(*a*) and 11(*b*) are views illustrating a sixth operation of the jet-propelled watercraft according to the present invention.
Figure 11B:
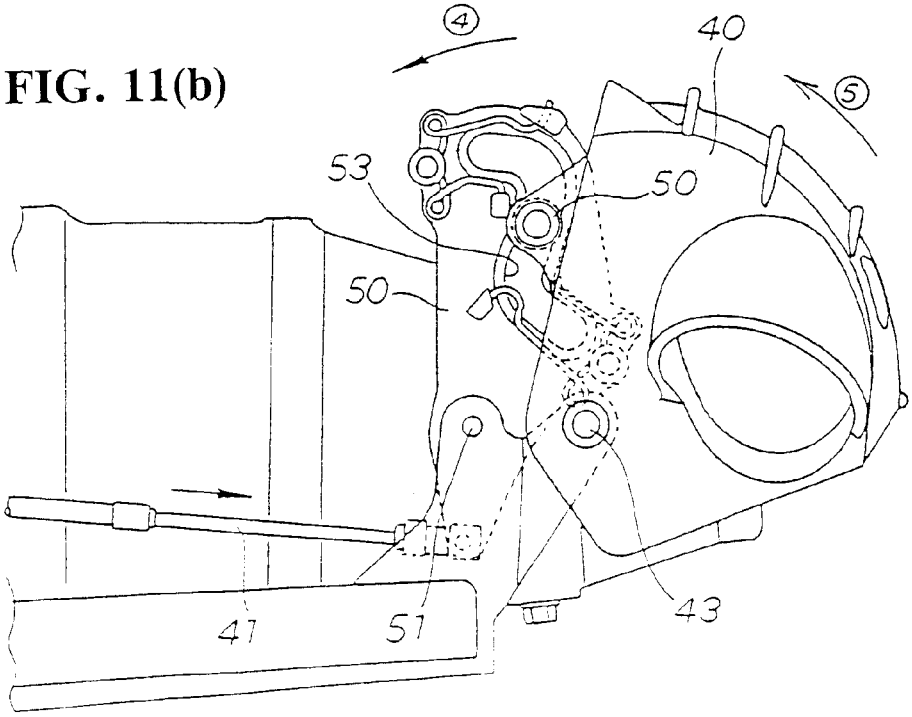

FIGS. 11(*a*) and 11(*b*) are views illustrating a sixth operation of the jet-propelled watercraft according to the present invention.

As shown in FIG. 11(*a*), when the portion 53*d* of the guide groove 53 reaches the slide member 55, the slide member 55 is removed from the reverse rock spring 57. When the intermediate lever 50 is, in such a state, swung as shown by the arrow ④, the slide member 55 is moved along the guide groove 53 toward the lower end 53*b* of the guide groove 53, thereby swinging the reverse bucket 40 around the supporting bolt 43 as shown by an arrow ⑤.

As shown in FIG. 11(*b*), the reverse bucket 40 swings continuously in the direction shown by the arrow ⑤ by operating the operating cable 41 as shown by an arrow. This occurs by the continuous swinging of the intermediate lever 50 around the supporting bolt 51 as shown by the arrow ④.

Figure 12:
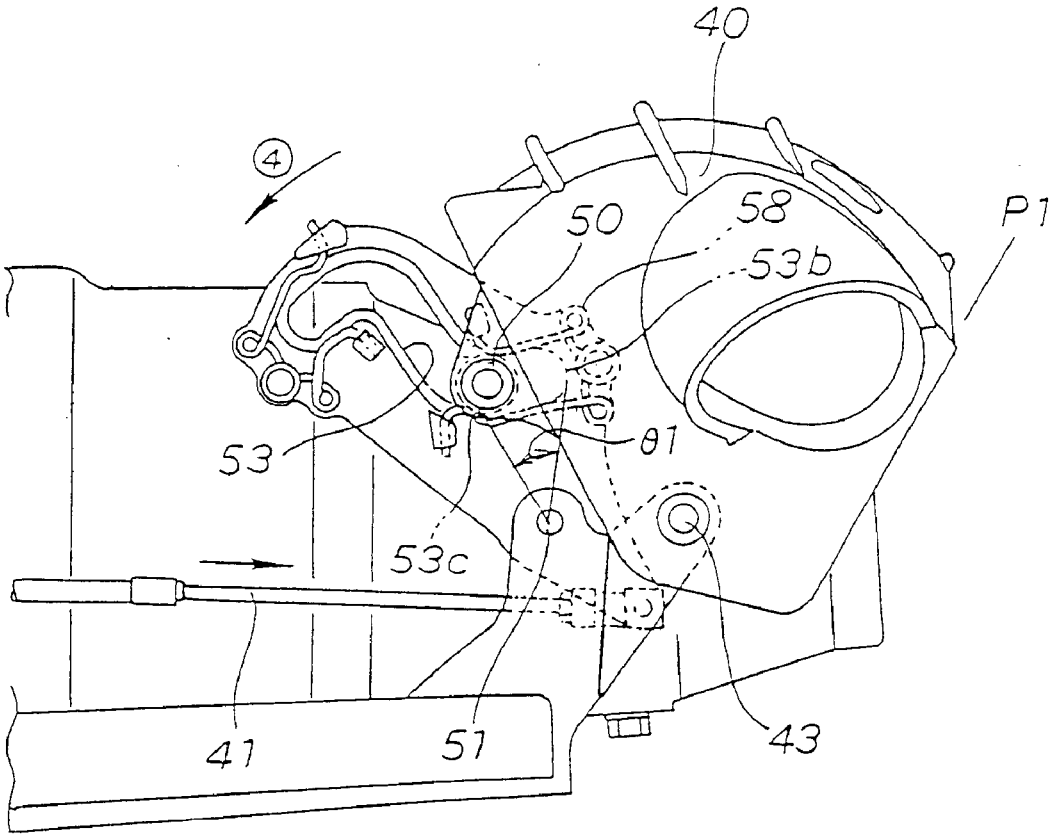
FIG. 12 is a view illustrating a seventh operation of the jet-propelled watercraft according to the present invention.

FIG. 12 is a view illustrating a seventh operation of the jet-propelled watercraft according to the present invention.

When the slide member 55 reaches the portion 53*c* of the guide groove 53, the reverse bucket 40 comes in contact with a stopper (not shown), whereby the reverse bucket 40 is bought to rest at the reverse position P1.

A portion of the guide groove 53 between the portion 53*c* and the lower end 53*b* is formed into a circular-arc centered at the supporting bolt 51. It is to be noted that the circular-arc between the portion 53*c* and the lower end 53*b* is open by an angle θ1. As a result, in the circular-arc region, even if the intermediate lever 50 is swung as shown by an arrow ④, both the reverse bucket 40 and the slide member 55 are kept at a rested position.

When the upper end 53*a* of the guide groove 53 comes in contact with the slide member 55, the intermediate lever 50 is rested. Such a state is equal to the state shown in FIG. 6(*a*). The operation of shifting the reverse bucket 40 to the forward position P1 is thus complete.

At this time, as shown in FIG. 6(*a*), the slide member 55 is clamped by the forward lock spring 58. When clamped by the forward lock spring 58, the slide member 55 expands the forward lock spring 58, thereby giving a slight resistance to the operating lever 60 (see FIG. 10(*a*)). As a result, a driver can sense the fact that the reverse bucket 40 has just been set to the forward position P1.

Figure 13A:
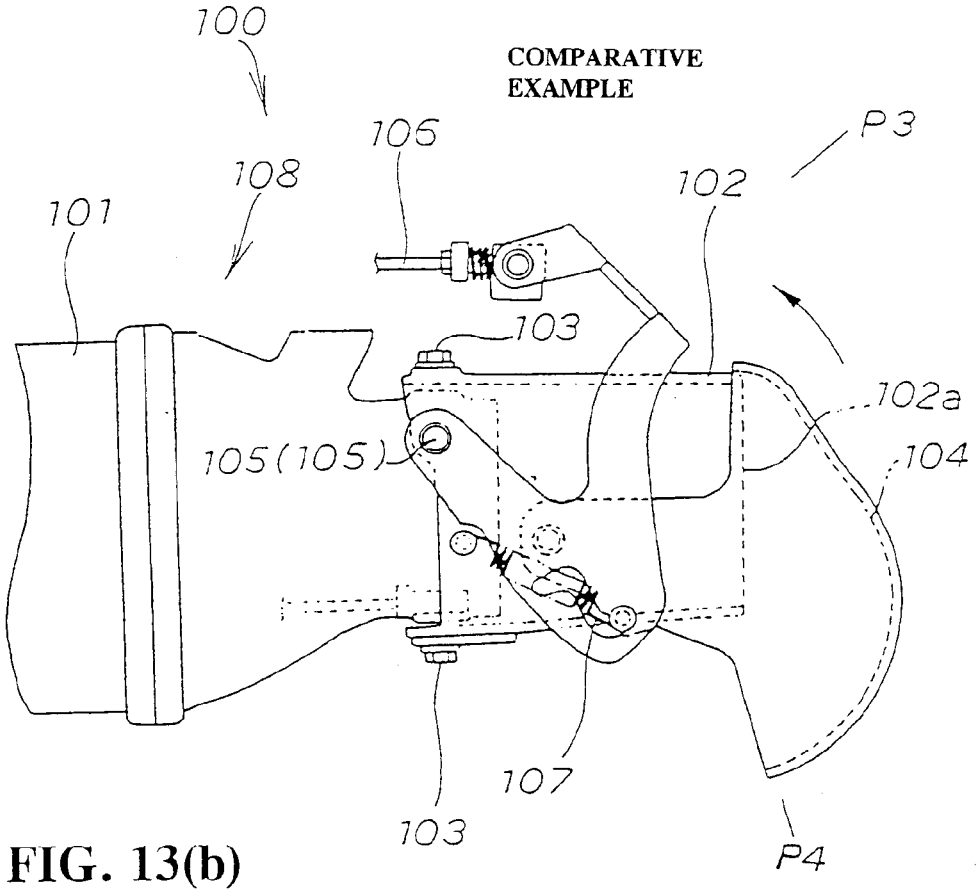
FIGS. 13(*a*) and 13(*b*) are views illustrating the jet-propelled watercraft according to the present invention in comparison with a related art jet-propelled watercraft.
Figure 13B:
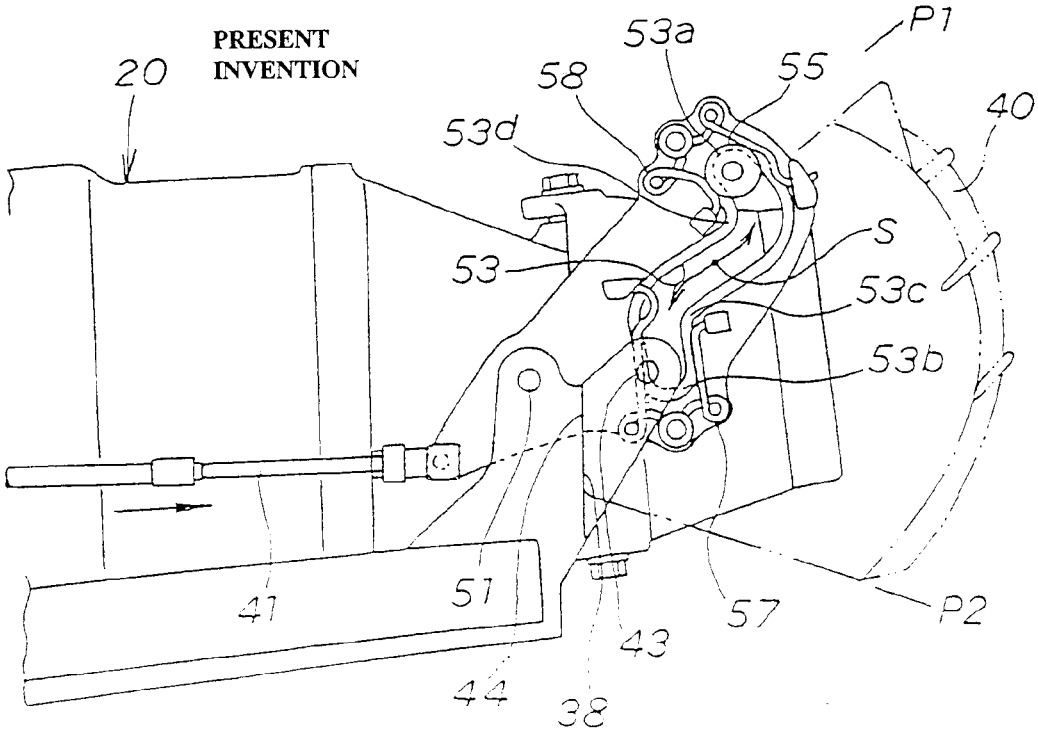
Figure 14:
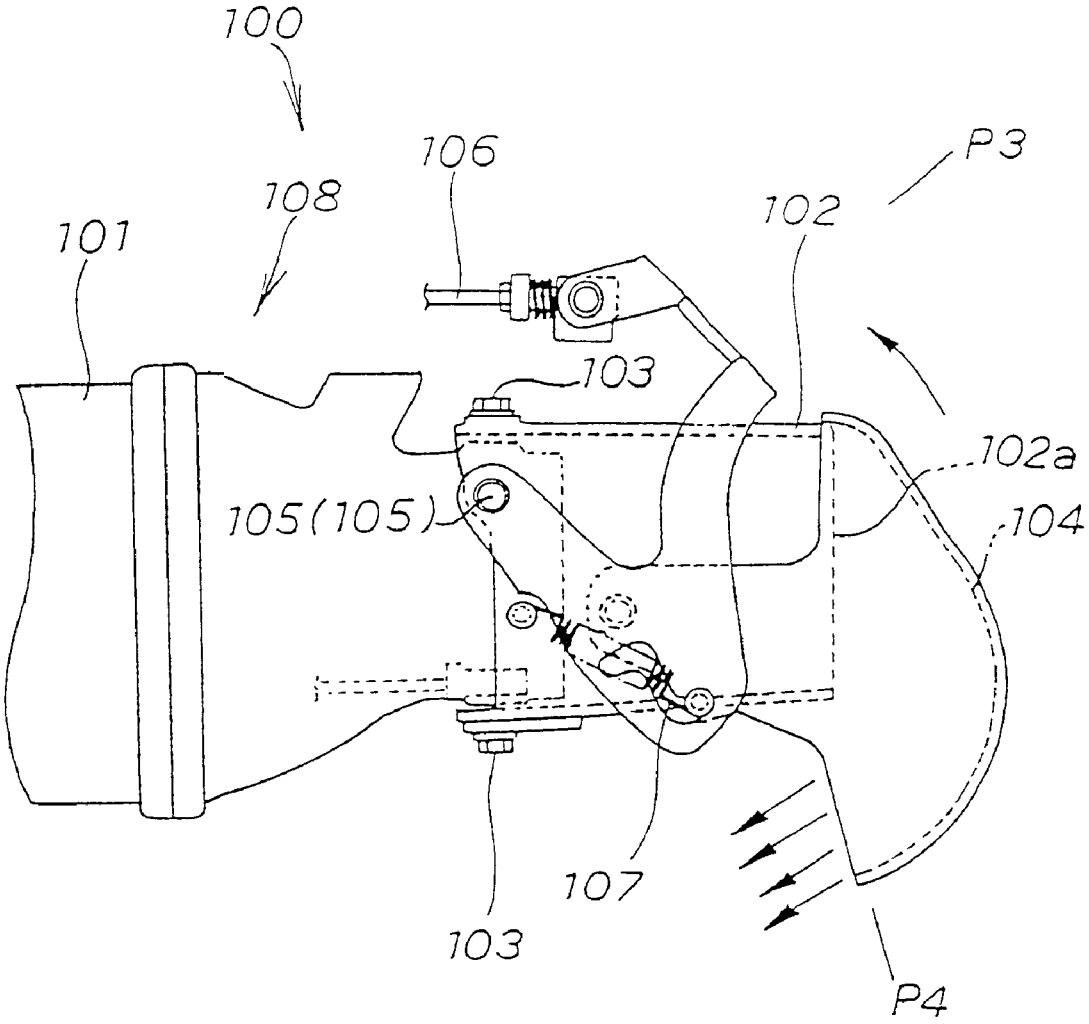
FIG. 14 is a side view showing an essential portion of the related art jet-propelled watercraft.

FIGS. 13(*a*) and 13(*b*) are illustrative views for comparing the jet-propelled watercraft according to the present invention with a related art jet-propelled watercraft. FIG. 13(*a*) shows the related art jet-propelled watercraft as a comparative example, and FIG. 13(*b*) shows the jet-propelled watercraft as an inventive example.

In the comparative example shown in FIG. 13(*a*), since the operating cable 106 for operating the reverse bucket 104 is disposed over a jet propulsion unit 101, a containing space is required for containing the operating cable 106 over the jet propulsion unit 101. This makes it difficult to achieve a low the center of gravity in the jet-propelled watercraft 100.

Another disadvantage of the comparative example is that since a tensile spring 107 is used as means for holding the reverse bucket 104 at a forward position P3 or a reverse position P4, a spring force of the tensile spring 107 is usually applied to an operating lever in the case of swinging the reverse bucket 104 between the forward position P3 and the reverse position P4. As a result, there is room for improvement of the operability of the reverse bucket 104.

By contrast, in the inventive example shown in FIG. 13(*b*), the operating cable 41 for operating the reverse bucket 40 can be disposed so as to extend along a left wall of the jet propulsion unit 20. As a result, no containing space for containing the operating cable 41 over the jet propulsion unit 20 is needed. Hence, a preferred layout for lowering the center of gravity of the jet-propelled watercraft 10 can be achieved.

Another advantage of the inventive example is to use the forward lock spring 58 and the reverse lock spring 57 as means for holding the reverse bucket 40 at the forward position P1 and the reverse position P2, respectively.

As a result, when swinging the reverse bucket 40 between the forward position P1 and the reverse position P2, no spring force of the lock spring 57 or 58 is applied to the operating lever 60 (see FIG. 2) in a gap S between the portions 53*c* and 53*d* of the guide groove 53. Accordingly, a more desirable operability of the reverse bucket 40 is achieved.

The inventive example has a further advantage that in the case of resting the reverse bucket 40 at the reverse position P2, the stopper piece 44 of the reverse bucket 40 can be brought into contact with the stopper 38 of the left supporting bracket 35. This makes it possible to rest the reverse bucket 40 at the reverse position P2 with certainty.

In the above embodiment, the intermediate lever 50 is disposed in the gap 42 between the left supporting bracket 35 and the steering nozzle 30, the intermediate lever 50 is swingably mounted to the left supporting bracket 35, and the operating cable 41 is connected to the reverse bucket 40 via the intermediate lever 50. However, the present invention is not limited thereto. Alternatively, the intermediate lever 50 be disposed in a gap between the right supporting bracket 36 and the steering nozzle 30, the intermediate lever 50 be swingably mounted to the right supporting bracket 36, and the operating cable 41 be connected to the reverse bucket 40 via the intermediate lever 50.

The present invention configured as described above has the following effects.

As described above, the intermediate lever is disposed in the gap between one of the supporting brackets and the steering nozzle and the operating cable is connected to the reverse bucket via the intermediate lever. Accordingly, the operating cable can be disposed along a side surface of the jet propulsion unit. As a result, the need for disposing the operating cable connected to the reverse bucket in a space over the jet propulsion unit is eliminated. Hence, a preferred layout in terms of lowering the center of gravity of the jet propulsion unit is obtained.

Also, since the pair of supporting brackets are provided on the left and right sides of the ride plate and the intermediate lever is disposed in the gap between one of the supporting brackets and the steering nozzle, it is possible to widen the gap between the pair of the supporting brackets. This makes it possible to form the reverse bucket with a greater width. Thus, the water stream jetted from the steering nozzle can be introduced into the reverse bucket more efficiently.

In addition, since the gap between the pair of supporting brackets can be widened, a space being large enough to form the supporting portions of the reverse bucket can be easily obtained. These supporting portion make it possible to add rigidity to the reverse bucket.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A jet-propelled watercraft with a jet nozzle for jetting water provided at a stern of the watercraft, comprising:

a jet propulsion unit for powering the watercraft;

a steering nozzle provided on said jet nozzle of said jet propulsion unit;

a ride plate removably mounted to a hull and covering a lower side of said steering nozzle;

a pair of supporting brackets provided on left and right sides of said ride plate;

a reverse bucket vertically swingably provided on said pair of supporting brackets;

an intermediate lever disposed in a gap between one of said pair of supporting brackets and said steering nozzle, said intermediate lever being swingably mounted to said one of said supporting brackets; and an operating cable connected to said reverse bucket via said intermediate lever, whereby said reverse bucket is swung by operating said intermediate lever via said operating cable, wherein the reverse bucket is provided with a containing pocket, and an upper end of the intermediate arm is inserted into the containing portion where it is connected to the reverse bucket.

2. The jet-propelled watercraft according to claim 1, wherein the intermediate lever is provided with a crank-shaped guide groove, and when the intermediate lever is operated, a slide member connected to the reverse bucket moves within guide groove thereby causing the reverse bucket to swing vertically.

3. The jet-propelled watercraft according to claim 1, wherein the reverse bucket is provided with jet ports on left and right walls of said reverse bucket.

4. The jet-propelled watercraft according to claim 1, wherein the reverse bucket is provided with left and right supporting portions for enhancing the rigidity of the reverse bucket, and the supporting portions are connected to the right and left supporting brackets.

5. The jet-propelled watercraft according to claim 1, wherein the operating cable connected to the intermediate lever extends forwardly from the intermediate lever along an outer side of the jet propulsion unit, and another operating cable connected to the steering nozzle extends forwardly along an opposite outer side of the jet propulsion unit.

6. The jet-propelled watercraft according to claim 5, wherein the operating cable connected to the intermediate lever is attached by a joint to a lower end of the intermediate lever at a point below another point where the intermediate lever is swingably mounted on the one of said supporting arms.

7. A jet-propelled watercraft with a jet nozzle for jetting water provided at a stern of the watercraft, comprising:

a steering nozzle provided on said jet nozzle;

a ride plate removably mounted to a hull and covering a lower side of said steering nozzle;

a pair of supporting brackets provided on left and right sides of said ride plate;

a reverse bucket vertically swingably provided on said pair of supporting brackets;

an intermediate lever disposed in a gap between one of said pair of supporting brackets and said steering nozzle, said intermediate lever being swingably mounted to said one of said supporting brackets; and an operating cable connected to said reverse bucket via said intermediate lever, whereby said reverse bucket is swung by operating said intermediate lever via said operating cable, wherein the reverse bucket is provided with a containing pocket, and an upper end of the intermediate arm is inserted into the containing portion where it is connected to the reverse bucket.

8. The jet-propelled watercraft according to claim 7, wherein the reverse bucket is provided with left and right supporting portions for enhancing the rigidity of the reverse bucket, and the supporting portions are connected to the right and left supporting brackets.

9. The jet-propelled watercraft according to claim 7, wherein the operating cable connected to the intermediate lever extends forwardly from the intermediate lever along an outer side of a jet propulsion unit of the watercraft, and another operating cable connected to the steering nozzle extends forwardly along an opposite outer side of said jet propulsion unit.

10. The jet-propelled watercraft according to claim 9, wherein the operating cable connected to the intermediate lever is attached by a joint to a lower end of the intermediate lever at a point below another point where the intermediate lever is swingably mounted on the one of said supporting arms.

11. The jet-propelled watercraft according to claim 7, wherein the intermediate lever is provided with a crank-shaped guide groove, and when the intermediate lever is operated, a slide member connected to the reverse bucket moves within guide groove thereby causing the reverse bucket to swing vertically.

12. A jet-propelled watercraft, wherein a jet nozzle for jetting water is provided at a stern, a steering nozzle is additionally provided for said jet nozzle, a lower side of said steering nozzle is covered with a ride plate removably mounted to a hull, a pair of supporting brackets are provided on left and right sides of said ride plate, and a reverse bucket is vertically swingably provided on said pair of supporting brackets, said jet-propelled watercraft comprising:

an intermediate lever disposed in a gap between one of said pair of supporting brackets and said steering nozzle, said intermediate lever being swingably mounted to said one of said supporting brackets; and an operating cable connected to said reverse bucket via said intermediate lever, whereby said reverse bucket is swung by operating said intermediate lever via said operating cable, wherein the operating cable is attached by a joint to a lower end of the intermediate lever at a point below another point where the intermediate lever is swingably mounted on the one of said supporting arms.

13. The jet-propelled watercraft according to claim 12, wherein the reverse bucket is provided with a containing pocket, and an upper end of the intermediate arm is inserted into the containing portion where it is connected to the reverse bucket.

14. The jet-propelled watercraft according to claim 13, wherein a spacer is disposed on an inner side of the intermediate lever and the slide member is disposed on an outer side of the intermediate lever, whereby a position of the intermediate lever in the containing portion can be adjusted.

15. The jet-propelled watercraft according to claim 12, wherein the reverse bucket is provided with jet ports on left and right walls of said reverse bucket.

16. The jet-propelled watercraft according to claim 12, wherein the reverse bucket is provided with left and right supporting portions for enhancing the rigidity of the reverse bucket, and the supporting portions are connected to the right and left supporting brackets.

17. The jet-propelled watercraft according to claim 12, wherein the operating cable connected to the intermediate lever extends forwardly from the intermediate lever along an outer side of a jet propulsion unit of the watercraft, and another operating cable connected to the steering nozzle extends forwardly along an opposite outer side of the jet propulsion unit.

18. The jet-propelled watercraft according to claim 12, wherein the intermediate lever is provided with a crank-shaped guide groove, and when the intermediate lever is operated, a slide member connected to the reverse bucket moves within guide groove thereby causing the reverse bucket to swing vertically.

* * * * *